US010912383B2

(12) United States Patent
Kusch

(10) Patent No.: US 10,912,383 B2
(45) Date of Patent: Feb. 9, 2021

(54) PIECE OF SEATING FURNITURE

(71) Applicant: Kusch + Co. GmbH & Co. KG, Hallenberg (DE)

(72) Inventor: Dieter Kusch, Hallenberg (DE)

(73) Assignee: Kusch + Co. GmbH & Co. KG, Hallenberg (DE)

( * ) Notice: Subject to any disclaimer, the term of this patent is extended or adjusted under 35 U.S.C. 154(b) by 64 days.

(21) Appl. No.: 16/467,684

(22) PCT Filed: Nov. 30, 2017

(86) PCT No.: PCT/EP2017/001392
§ 371 (c)(1),
(2) Date: Jun. 7, 2019

(87) PCT Pub. No.: WO2018/108309
PCT Pub. Date: Jun. 21, 2018

(65) Prior Publication Data

US 2020/0060421 A1 Feb. 27, 2020

(30) Foreign Application Priority Data

Dec. 12, 2016 (DE) ..... 10 2016 014 695
Dec. 29, 2016 (DE) ..... 10 2016 015 594

(51) Int. Cl.
*A47B 91/06* (2006.01)
*A47B 91/08* (2006.01)
(Continued)

(52) U.S. Cl.
CPC ..... *A47B 91/066* (2013.01); *A47B 91/08* (2013.01); *A47C 11/005* (2013.01); *A47C 31/003* (2013.01)

(58) Field of Classification Search
CPC ..... A47B 91/066; A47B 91/08; A47B 91/12; A47C 31/003
See application file for complete search history.

(56) References Cited

U.S. PATENT DOCUMENTS 2,857,616 A 10/1958 Becker
3,207,551 A * 9/1965 Axtell ..... A47B 91/06 297/248
(Continued)

FOREIGN PATENT DOCUMENTS

DE 102012202172 A1 8/2013

OTHER PUBLICATIONS

International Search Report and Written Opinion dated Jan. 22, 2018 in International Patent Application No. PCT/EP2017/001392 filed Nov. 30, 2017, all pages. (English Translation of International Search Report also included).
(Continued)

*Primary Examiner* — David R Dunn
*Assistant Examiner* — Tania Abraham
(74) *Attorney, Agent, or Firm* — Kilpatrick Townsend & Stockton LLP

(57) ABSTRACT

A piece of seating furniture having a base framework and having a seat surface fastened to the base framework, wherein the base framework has a plurality of legs, on the underside of each of which there is fastened an adjusting slider, characterized in that at least two of the adjusting sliders are of two-part design, each having a holding magnet arranged on a leg of the base framework and each having an adjusting slider cup which can be fixed to a floor, with a cup receptacle of a ferromagnetic material as an adhesive base, wherein the cup receptacle and the holding magnet can be placed one inside the other in a shape-adapted manner, for which purpose the holding magnet is fastened to the respective leg in an angularly movable manner.

12 Claims, 3 Drawing Sheets

Figure 2A:
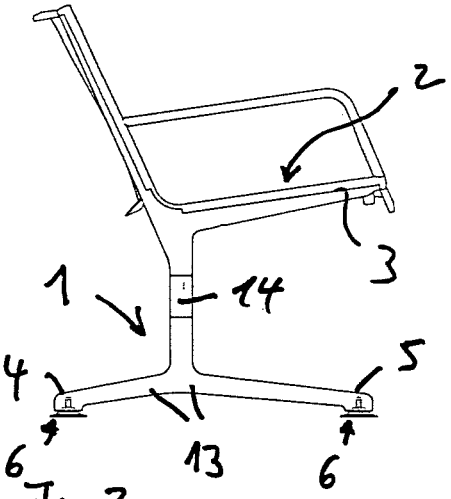

(51) Int. Cl.
*A47C 11/00* (2006.01)
*A47C 31/00* (2006.01)

(56) References Cited

U.S. PATENT DOCUMENTS

| | | | | |
|---|---|---|---|---|
| 5,094,416 | A | 3/1992 | Huon | |
| 5,310,156 | A * | 5/1994 | Matsumura | A47B 91/00 248/188.9 |
| 6,042,183 | A | 3/2000 | Carnahan et al. | |
| 6,840,488 | B2 * | 1/2005 | Ngo | A47B 91/12 248/188.2 |

OTHER PUBLICATIONS

Examination Report dated May 11, 2018 in German Patent Application No. 102013017193.8 filed Oct. 16, 2013, all pages. (No English Translation available).
International Preliminary Report on Patentability dated Jun. 18, 2019 in PCT Patent Application No. PCT/EP2017/001392 filed Nov. 30, 2017, English translation, all pages.

* cited by examiner

PIECE OF SEATING FURNITURE

The invention relates to a piece of seating furniture having a base framework as claimed in the preamble of claim 1.

In particular chairs, armchairs, office chairs and benches belong to the field of pieces of seating furniture. All of these pieces of seating furniture generally have adjusting sliders which, on the one hand, protect the floor surfaces and, on the other hand, make it easier to position and/or displace the pieces of seating furniture.

A piece of seating and reclining furniture which is supported by sliders relative to the floor for simplifying the conversion movement is disclosed in EP 0 006 839 A1. A drawback is that positioning a plurality of such pieces of seating furniture is time-consuming.

It is, therefore, the object of the invention to provide a piece of seating furniture as claimed in the preamble of claim 1 which provides the means of being positioned and used rapidly and in an accurate position.

This object is achieved by the features of claim 1.

As a result, a piece of seating furniture is provided, said piece of seating furniture being able to be rapidly positioned by the two-part adjusting sliders according to the invention and according to individual specifications. The fixing of holding magnets in adjusting slider cups permits a stable but releasable positioning of the piece of seating furniture on a floor, to which end only the adjusting slider cups have to be fixed to the floor. The piece of seating furniture is then easily inserted into the adjusting slider cups by the associated legs and the holding magnets provided at that point. The magnetic forces ensure a sufficient connecting force, so that a screwed-on connection or a different mechanical connection by the use of connecting elements is dispensed with.

An angularly movable fixing of the holding magnet onto the leg compensates for a possible misalignment of a contact surface of the holding magnet relative to a cup receptacle. A reduction in the locking force of the holding magnets due to possible air gaps between the contact surface of the holding magnet and the cup receptacle is prevented thereby. The piece of seating furniture is thus able to be positioned in a secure and non-displaceable manner. The angularly movable fixing relative to the positioning plane of the piece of seating furniture may, for example, be implemented by an elastic intermediate part, for example a permanently elastic coupling element, or via an intermediate part for receiving a cardanic suspension.

The fixing of the adjusting slider cups to the floor by means of preferably adhesive auxiliary means is advantageous since the adjusting slider cups are able to be formed with an individually flat floor positioning surface. A high contact force is thus able to be achieved. The magnetic force exerted by the holding magnets effects a self-locking connection between the two parts of the two-part adjusting slider. A secure and reliable retained fixing of the piece of seating furniture during a positioning mode is provided thereby.

In this case it is sufficient that adjusting sliders, which are preferably arranged only along a fastening line, are configured according to the invention in two parts, for example along the front legs or along the rear legs or along the right-hand or left-hand legs, in the case of a piece of seating furniture comprising, for example, four legs. Thus the piece of seating furniture may be lifted in a simple manner on the side of the adjusting sliders which are configured to be non-magnetic in order to release the magnetic connection, via the acting tilting forces. Alternatively, if all or substantially all of the adjusting sliders according to the invention are configured to be magnetic, holding magnets with different magnetic holding forces may be installed. For shifting or dismantling the piece of seating furniture, the adjusting sliders which have weaker holding magnets may be initially released, by for example being lifted away, whilst the stronger holding magnets are releasable via tilting forces.

The holding magnets are positioned so as to be inserted in protective caps on the respective legs in order to prevent damage to the holding magnets. Such a protection which is implemented in the manner of an outer casing also permits the formation of visually attractive adjusting sliders irrespective of the integrated magnet technology. For the permanent fastening of the holding magnets to a leg of the base framework, for example, a screw connection is provided.

It is also advantageous if the adjusting slider cup, for example, is able to be formed with a peripheral edge bead, the holding magnet penetrating therein. A lateral securing of the magnetic holder in a shape-adapted manner may be achieved thereby.

The piece of seating furniture, for example, is a bench with a number of seating elements which are arranged along a transverse member or a crossmember and with base framework legs on the edge side which are configured in the manner of projections and which in each case have two legs with one respective adjusting slider. When the benches are used, the transverse member conducts the loads which act on the seating elements into the base framework legs which are supported via the adjusting sliders on the floor. As a result, the holding magnets are pushed into the adjusting slider cups by a high compressive load so that the magnetic connection may be additionally mechanically secured by the applied load.

Further embodiments of the invention may be derived from the following description and the subclaims.

The invention is described in more detail hereinafter with reference to the exemplary embodiments shown in the accompanying drawings.

Figure 3A:
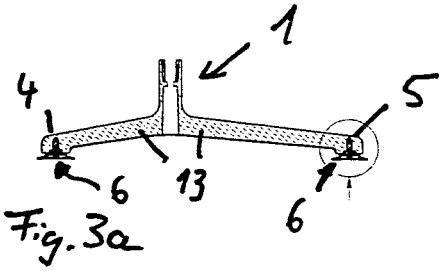
Figure 4A:
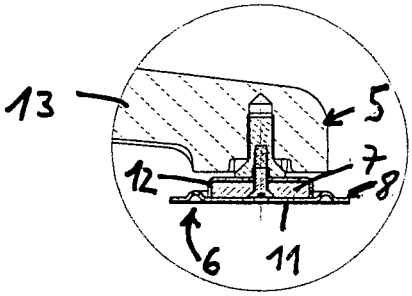
Figure 1A:
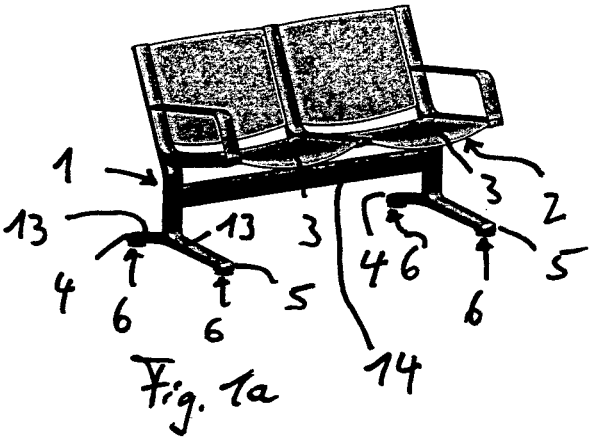
Figure 2B:
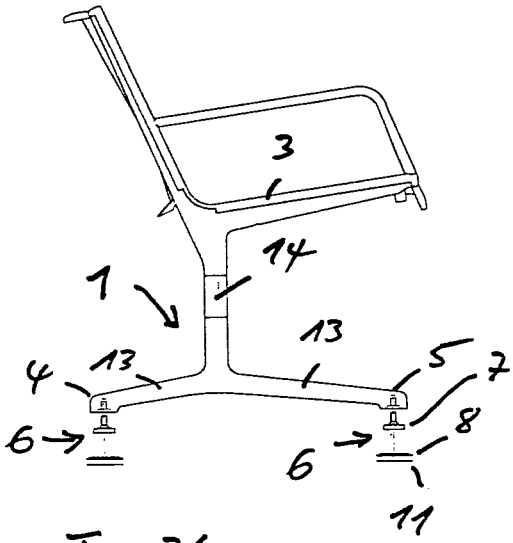
Figure 3B:
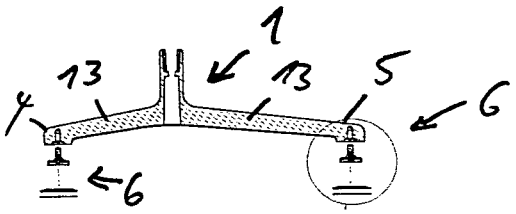
Figure 4B:
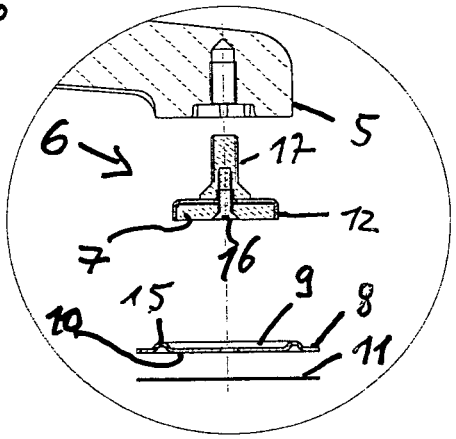
Figure 1B:
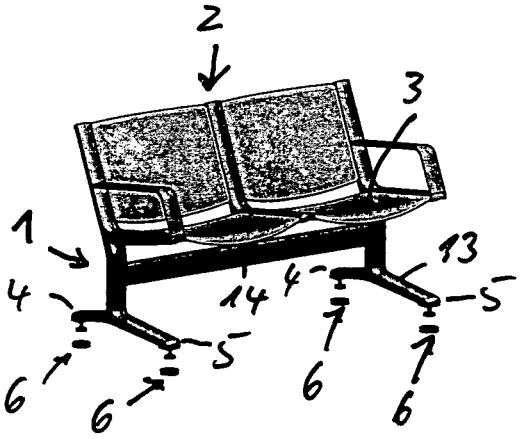
Figure 5:
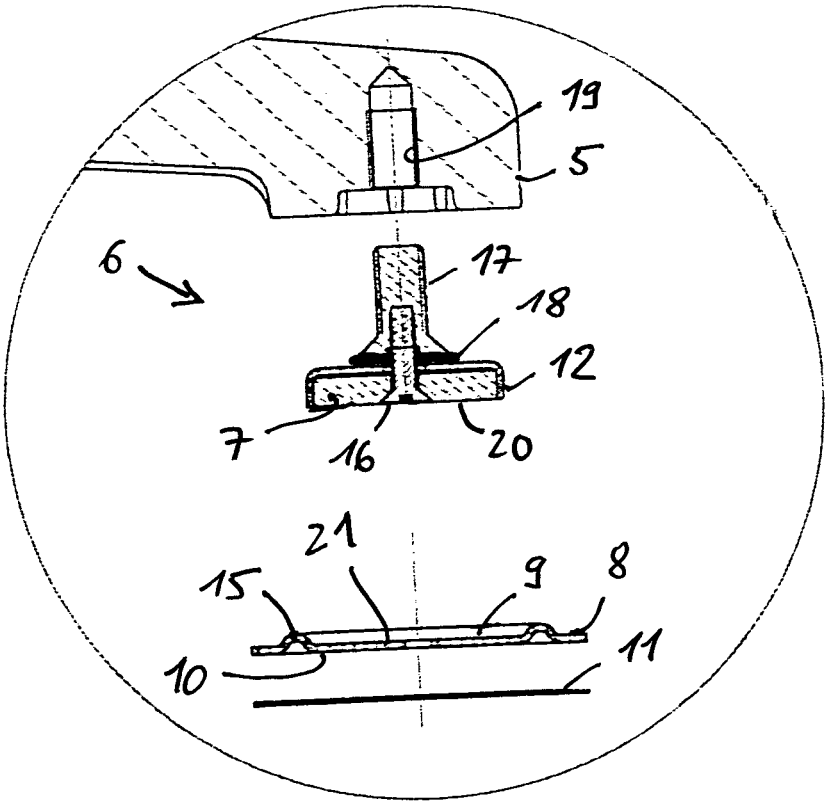

FIG. 1*a* shows schematically a perspective view of a piece of seating furniture obliquely from the front with two-part adjusting sliders according to a first exemplary embodiment, FIG. 1*b* shows schematically a perspective view of the piece of seating furniture according to a first exemplary embodiment obliquely from the front with two-part adjusting sliders which are released, FIG. 2*a* shows a side view of FIG. 1*a*, FIG. 2*b* shows a side view of FIG. 1*b*, FIG. 3*a* shows a section of FIG. 2*a*, FIG. 3*b* shows a section of FIG. 2*b*, FIG. 4*a* shows the marked region of FIG. 3*a* enlarged, FIG. 4*b* shows the marked region of FIG. 3*b* enlarged, FIG. 5 shows the marked region of FIG. 3*b* enlarged and according to a second exemplary embodiment.

As FIG. 1*a* and FIG. 1*b* show, the invention relates to a piece of seating furniture having a base framework 1 and having a seat surface 2 fastened to the base framework 1 with one or more seating places 3 according to a first exemplary embodiment. The base framework 1 has a plurality of legs 4, 5, on the underside of each of which there is fastened an adjusting slider 6. The adjusting sliders then form the floor contact surface of the piece of seating furniture.

As in particular FIG. 4*a* and FIG. 4*b* show, according to the invention it is provided that at least two of the adjusting sliders 6 are of two-part design, each having a holding magnet 7 fastened to a leg 4, 5 of the base framework 1 and each having an adjusting slider cup 8 which can be fixed to a floor (not shown). The adjusting slider cup 8 has a cup receptacle 9 of a ferromagnetic material as an adhesive base, wherein the cup receptacle 9 and the holding magnet 7 can be placed one inside the other in a shape-adapted manner.

The at least two two-part adjusting sliders 6 are preferably provided on adjacent legs 4, 5, for example on two rear legs 4 or two front legs 5, or, however, on two right-hand legs 4, 5 or two left-hand legs 4, 5.

The respective adjusting slider cup 8 is preferably formed from a steel sheet. The adjusting slider cup 8 preferably has a flat floor positioning surface 10.

For fixing the adjusting slider cup 8 to a floor surface preferably a double-sided adhesive tape 11 made of a closed-cell polyethylene foam with acrylate adhesive is able to be attached to the adjusting slider cup 8, in particular to the floor positioning surface 10 thereof.

The holding magnet 7 in each case is preferably a permanent magnet made of a magnetic material with a high coercive field strength.

According to the exemplary embodiment shown, all of the adjusting sliders 6 of the legs 4, 5 may also be designed in two parts and with a holding magnet 7. In order to simplify the release of the magnetic connection it may be provided that a holding force of the holding magnets 7 of the adjusting sliders 6 for the front legs 5 is different from a holding force of the holding magnets 7 of the adjusting sliders 6 for the rear legs 4. Alternatively or additionally, a holding force of the holding magnets 7 of the adjusting sliders 6 for the right-hand legs 4, 5 may be different from a holding force of the holding magnets 7 of the adjusting sliders 6 for the left-hand legs 4, 5. The strengths of the magnetic holding forces are preferably different, such that the one strength is less than 35% of the other strength.

The respective holding magnet 7 is also preferably able to be fixed in a protective cap 12.

The base framework 1 may have legs 4, 5 which are arranged on frame legs 13 which are connected together via a transverse member 14. The transverse member 14 preferably supports a plurality of seating places 3 forming a seat bench.

In the exemplary embodiment shown in the figures, the piece of seating furniture is configured, for example, as a two seater bench. The base framework 1 has right-hand and left-hand framework legs 13 which, for example, bear a total of four legs 4, 5, two front legs 5 and two rear legs 4. At least the two front legs 5 are provided with an adjusting slider 6 which contains a holding magnet 7 as described above. The two holding magnets 7 are preferably strong permanent magnets. Two adjusting slider cups 8 which, for example, are configured as two compressed round plates and, for example, consist of a galvanized metal plate form the magnetically acting counter element. Due to the cup shape of the adjusting slider cups 8 a peripheral raised edge 15 (see FIG. 4*b*) is configured. If the adjusting slider cup 8 is configured, for example, as a plate, an annular edge which prevents the holding magnets 7 from slipping out of the cup is thus formed. The adjusting slider cups 8 of the at least front legs 5 are preferably fixed by the double-sided adhesive tape 11, for example onto a stone floor of a building, for example of an airport terminal.

The piece of seating furniture may thus be inserted with the holding magnets 7 into the adjusting slider cups 8. The effective magnetic force between the holding magnets 7 and the fixed adjusting slider cups 8 positions and fixes the piece of seating furniture, wherein at the same time said piece of seating furniture is secured against displacement.

A fastening of the holding magnets 7 to the leg 5 may, for example, be carried out by means of a screw fastening 16. To this end, a screw intermediate part 17 may be screwed into the leg.

According to a second exemplary embodiment of the piece of seating furniture, it is provided that the respective holding magnet 7 is fastened to the respective leg 4, 5 in an angularly movable manner. As shown in FIG. 5, the holding magnet 7 is able to be coupled, for example, in an angularly movable manner to the respective leg 4, 5 via an elastic intermediate part 18. The holding magnet 7 and the preferably provided screw intermediate part 17 are coupled via the elastic intermediate part 18 and a bolted connection, by means of the screw fastening 16. The screw intermediate part 17 is able to be screwed into a preferably vertically oriented screw hole 19 in the leg 4, 5. A contact surface 20 of the holding magnets 7 is thus angularly movable relative to the positioning plane of the piece of seating furniture which is determined by the floor and the cup receptacle 9 arranged thereon. A substantial air gap for freely positioning the holding magnet 7 with its contact surface 20 on a floor contact surface 21 of the cup receptacle 9 is ensured thereby, since it is possible to compensate for unevenness or other oblique positions. The locking force of the holding magnets 7 may be used substantially unimpeded, by the action of gravity of the piece of seating furniture which effects the angularly movable alignment of the holding magnet 7. Moreover, the embodiments relative to the first exemplary embodiment accordingly apply here.

According to a further exemplary embodiment, not shown further, for the angularly movable fastening of the holding magnet 7 on the respective leg 4, 5 a type of cardanic suspension may be provided alternatively or additionally to the elastic intermediate part 18. Moreover, the embodiments relative to the first exemplary embodiment accordingly apply here.

The invention claimed is:

1. A piece of seating furniture having a base framework and having a seat surface fastened to the base framework, wherein the base framework has a plurality of legs, on the underside of each of which there is fastened an adjusting slider, wherein at least two of the adjusting sliders are of two-part design, each having a holding magnet arranged on a leg of the base framework and each having an adjusting slider cup which can be fixed to a floor, with a cup receptacle of a ferromagnetic material as an adhesive base, wherein the cup receptacle and the holding magnet can be placed one inside the other in a shape-adapted manner, for which purpose the holding magnet is fastened to the respective leg in an angularly movable manner.

2. The piece of seating furniture as claimed in claim 1, wherein the holding magnet is able to be coupled in an angularly movable manner to the respective leg via an elastic intermediate part.

3. The piece of seating furniture as claimed in claim 1, wherein the holding magnet is able to be fastened in an angularly movable manner to the respective leg in the manner of a cardanic suspension.

4. The piece of seating furniture as claimed in claim 1, wherein the at least two two-part adjusting sliders are provided on adjacent legs.

5. The piece of seating furniture as claimed in claim 1, wherein the adjusting slider cup has a flat floor positioning surface, a double-sided adhesive tape made of a closed cell polyethylene foam with acrylate adhesive being able to be attached thereto.

6. The piece of seating furniture as claimed in claim 1, wherein two-part adjusting sliders are provided on the respective front or rear or on the respective right-hand or left-hand legs.

7. The piece of seating furniture as claimed in claim 1, wherein in each case two-part adjusting sliders are provided on the front and rear legs.

8. The piece of seating furniture as claimed in claim 7, wherein a holding force of the holding magnets of the adjusting sliders for the front legs is different from a holding force of the holding magnets of the adjusting sliders for the rear legs.

9. The piece of seating furniture as claimed in claim 7, wherein a holding force of the holding magnets of the adjusting sliders for the right-hand legs is different from a holding force of the holding magnets of the adjusting sliders for the left-hand legs.

10. The piece of seating furniture as claimed in claim 1, wherein the respective holding magnet is able to be fixed in a protective cap.

11. The piece of seating furniture as claimed in claim 1, wherein the base framework has legs which are arranged on frame legs which are connected together via a transverse member.

12. The piece of seating furniture as claimed in claim 11, wherein the transverse member supports a plurality of seating places forming a seat bench.

* * * * *